United States Patent [19]

Miller

[11] 4,383,339

[45] May 17, 1983

[54] BIDET ADAPTOR FOR TOILET

[76] Inventor: Daniel C. Miller, P.O. Box 860, Bethel Island, Calif. 94511

[21] Appl. No.: 267,500

[22] Filed: May 27, 1981

[51] Int. Cl.[3] ..... A47K 3/22; A47K 11/08

[52] U.S. Cl. ..... 4/448; 4/420.4; 4/443; 4/447

[58] Field of Search ..... 4/420.1, 420.2, 420.4, 4/420.3, 443, 444, 447, 448

[56] References Cited

U.S. PATENT DOCUMENTS

| | | | |
|---|---|---|---|
| 2,344,561 | 3/1944 | Popil | 4/420.4 |
| 2,504,257 | 4/1950 | Dunn | 4/448 |
| 2,528,095 | 10/1950 | Ward | 4/420.1 |
| 2,605,477 | 8/1952 | Monserrat | 4/448 |
| 2,705,495 | 4/1955 | Vrana et al. | 4/420.1 X |
| 2,957,180 | 10/1960 | McMullen | 4/420.2 |
| 2,995,759 | 8/1961 | Gentry | 4/420.1 |
| 3,164,846 | 1/1965 | Foster | 4/448 |
| 3,256,531 | 6/1966 | Arensberg | 4/448 |
| 3,310,813 | 3/1967 | Jonsson | 4/448 |
| 4,135,255 | 1/1979 | Manandaz | 4/448 |
| 4,181,985 | 1/1980 | Rius | 4/420.4 |

FOREIGN PATENT DOCUMENTS

| | | | |
|---|---|---|---|
| 418997 | 2/1967 | Switzerland | 4/420.4 |

*Primary Examiner*—Henry K. Artis

*Attorney, Agent, or Firm*—Townsend and Townsend

[57] ABSTRACT

A portable device for adapting a toilet for use as a bidet comprising a rigid conduit having a generally horizontal portion sized to fit in the gap between the bottom surface of the toilet seat and the top surface of the toilet bowl rim, and a generally U-shaped portion for upwardly discharging a column of water. The end of the horizontal conduit portion remote from the U-shaped portion is connected to a water supply line. The adaptor further comprises a second rigid conduit having a horizontal portion sized to fit between the toilet seal and the toilet bowl rim with a donwwardly opening end, and a diverter valve operable to selectively direct water into either of the two conduits. The two conduits are horizontally spaced apart to provide stabilization. In the preferred embodiment, the first and second onduits are in major part defined by hollow passageways within an integrally formed plastic body member.

12 Claims, 9 Drawing Figures

BIDET ADAPTOR FOR TOILET

This invention relates generally to bathroom fixtures, and more specifically to devices for adapting a toilet for use as a bidet.

BACKGROUND OF THE INVENTION

A bidet provides an upwardly discharging column of water beneath a seated user. The use of a bidet is desirable for personal hygiene and medical reasons since the toilet tissue in modern use is only a partial cleaning agent. Urologists and proctologists believe that the incidence of bladder infections and the like could be substantially eliminated if people would make routine use of a bidet in order to cleanse the perineal area. Due to the configuration of the female anatomy, women appear to be more prone to such disorders. Additionally, the bidet may be a useful therapeutic device for promoting healing after surgical operations such as episiotomies.

It has been common in Western European countries to provide a bidet as a unit separate from the toilet. However, such a unit takes up additional floor space, and requires plumbing that is more elaborate than that of the toilet itself due to the need to provide hot and cold water. In addition, the expense of the bidet itself must be considered.

The above problems can be overcome by a device that would adapt a standard toilet to perform the additional functions of a bidet. The prior art in this area is voluminous, clearly suggesting that many people believe the idea to be a good one. Most of the prior art devices are relatively elaborate devices that are attached to the toilet bowl in question in such a manner that they tend to be substantially non-removable. It is clear that a substantially permanently attached device interferes with normal usage of the toilet no matter how unobtrusive the device is designed to be, and further interferes with cleaning of the toilet. Additionally, a bidet adaptor that resides permanently on the toilet is easily contaminated by body wastes, thereby largely defeating a major purpose for which the device is used in the first place. Furthermore, such fixed devices are in general not readily adjustable as to position and further may not be readily adaptable to more than a narrow range of toilet bowl configurations.

There have been a number of portable bidet adaptors, some of which are suitable for a wide range of toilet bowl configurations. Such portable bidet adaptors often depend on a faucet in the bathroom to provide a source of water at a proper temperature and pressure. A water supply line is typically connected to the faucet by means of a suitable connector which may be held to the faucet by friction or by positive means (e.g. threads).

However, even these prior art devices have not been entirely satisfactory, since they have generally been either non-adjustable once in place, or difficult to adjust by a user sitting on the toilet seat. A further problem arises from the occasional need to temporarily interrupt the discharging column of water. Turning off the water faucet would necessitate a readjustment to achieve the desired pressure and temperature while placing an on/-off valve in the bidet adaptor supply line at a location convenient to the user may be impractical when a friction fit faucet connector is used, since such a connector might not hold under the pressure caused by closing off the line at a downstream point.

Efforts to design a bidet adaptor that is simple and inexpensive to manufacture, easy to position and adjust, and whose upward discharge of water may be easily and conveniently interrupted, have in general been unsuccessful to date. As a result, bidet adaptors have not become commonly used and their potential advantages have remained largely unrealized.

SUMMARY OF THE INVENTION

The present invention provides a portable device for adapting a toilet for use as a bidet. The device is of simple construction and may be easily adjusted by a user to provide precise positioning over the toilet bowl. The device provides an upwardly discharging column of water that may be easily and conveniently interrupted.

Broadly, a bidet adaptor constructed according to the present invention comprises a rigid conduit having a generally horizontal portion sized to fit in the gap between the bottom surface of the toilet seat and the top surface of the toilet bowl rim, and a generally U-shaped portion having a segment extending downwardly from an end of the horizontal portion and an upwardly opening end for upwardly discharging a column of water. A nozzle may be fitted to the upwardly open end. The end of the horizontal conduit portion remote from the U-shaped portion is connected to a water supply line, typically a flexible hose which may be connected to a convenient bathroom faucet by any suitable removable connector. The horizontal conduit portion is of sufficient length to permit horizontal longitudinal movement of the adaptor in order to permit positioning of the upwardly discharging column of water over the bowl at various distances from the rim, thereby accommodating a wide variety of toilet bowl and/or user configurations.

The bidet adaptor of the present invention further comprises diversion means for discharging the stream of water downwardly into the toilet bowl while the U-shaped conduit portion is maintained in its upwardly opening position. The bidet adaptor further comprises stabilization means associated with the diversion means to keep the U-shaped portion in its upwardly opening position.

In a preferred embodiment, the diversion means and stabilization means together comprise a separate rigid conduit having a horizontal portion sized to fit between the toilet seat and the toilet bowl rim, and a diverter valve. The diverter valve has an inlet in communication with the water supply line, and is operable to selectively direct water into either of the two conduits. The second conduit has an end remote from the diverter valve that is downwardly opening when the U-shaped conduit portion is positioned in its upwardly opening configuration. A user need merely actuate the diverter valve to select which of the two conduits the water is to flow through. The two conduits are horizontally spaced apart to provide stabilization.

The use of the second conduit and diverter valve provides a number of important advantages. In particular, when it is desired to interrupt the upwardly discharging column of water, the diverter valve is set to discharge the water through the second conduit downwardly into the bowl. This permits the use of a friction fit faucet coupling since the interruption of the upwardly discharging column is not accompanied by a build up of pressure in the supply line as would be the case as with a simple on-off valve. At the same time, by discharging the water downwardly, the user is able to more conveniently adjust the temperature and pressure of the stream.

In the preferred embodiment, the first and second conduits are in major part defined by hollow passageways within an integrally formed plastic body member having a generally plate-like configuration. The body member is of stepped configuration having an upper horizontal body portion, a downwardly extending body portion, and a lower horizontal body portion. The upper horizontal body portion is sized to fit within the gap between the seat and the rim, and has the horizontal conduit portions formed therein. The first conduit passageway communicates to an upwardly opening nozzle on the lower horizontal body portion while the second conduit passageway terminates in a downwardly facing opening. The integral construction, in addition to providing a relatively inexpensive means of fabricating the device, has the important advantage of presenting a smooth and regular outer surface so that the bidet adaptor may be easily cleaned.

For a further understanding of the nature and advantages of the invention, reference should be had to the ensuing detailed description taken in conjunction with the accompanying drawings.

DESCRIPTION OF THE PREFERRED EMBODIMENTS

Figure 1:
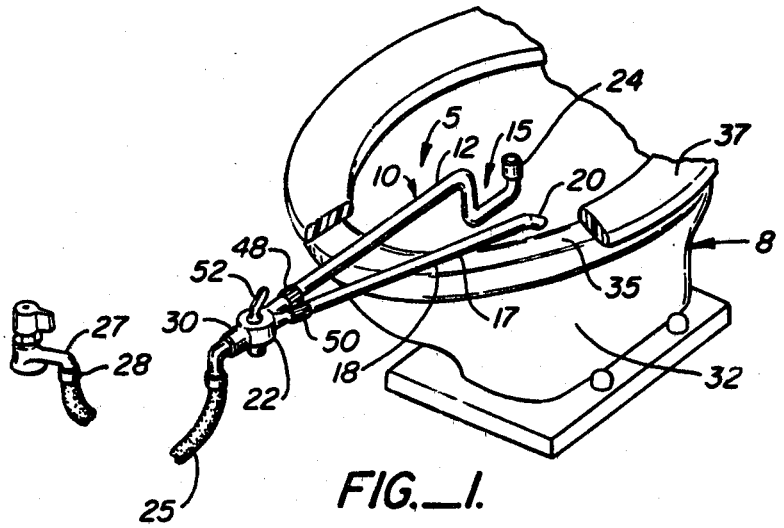
FIG. 1 is an isometric view of a first embodiment of the bidet adaptor according to the present invention, illustrating the relationship between the adaptor and a toilet bowl.

FIG. 1 is an isometric view of a bidet adaptor 5 constructed according to the teachings of the present invention, and shows the relationship between adaptor 5 and a toilet 8. Broadly, adaptor 5 comprises a first rigid conduit 10 including a generally straight horizontal portion 12 and a U-shaped portion 15, a second rigid conduit 17 having a generally horizontal portion 18 and a contiguous downwardly opening portion 20, and a diverter valve 22. U-shaped conduit portion 15 preferably terminates in an upwardly opening aerator nozzle 24 of conventional design. A flexible hose 25 is connected at a first end to a conventional faucet 27, preferably of the temperature mixing variety, by a faucet connector 28. Connector 28 may be of any suitable design for connecting to the available faucet, but it is anticipated that in many cases the faucet is unthreaded and requires that connector 28 be of the friction fit variety. Hose 25 is connected at its other end to an inlet 30 of diverter valve 22.

Toilet 8 is of standard configuration, and typically comprises a bowl 32 having an upper peripheral rim 35, and a seat 37, shown partially cutaway, overlying bowl rim 35 and spaced apart therefrom by a predetermined gap. The gap is typically maintained by a plurality of rubber bumpers (not shown) on the underside of seat 37.

Diverter valve 22 is of standard configuration, and has first and second outlets 48 and 50 communicating to conduits 10 and 17, respectively. A valve handle 52, or a similar manually actuable element, permits the user to selectively direct water into either of outlets 48 and 50, and thus control whether the water from faucet 27 issues upwardly through nozzle 24 or downwardly out of conduit portion 20.

The vertical cross-sectional dimensions of horizontal conduit portions 12 and 18 are no greater than the predetermined gap spacing to permit a sliding fit of the adaptor between rim 35 and seat 37. This allows the user to adjust the position of nozzle 24 and thus accommodate a variety of toilet bowls and user requirements. At the same time, horizontal conduit portions 12 and 18 are spaced apart to provide stabilization and maintain nozzle 24 in an upwardly opening orientation without user intervention.

Figure 2:
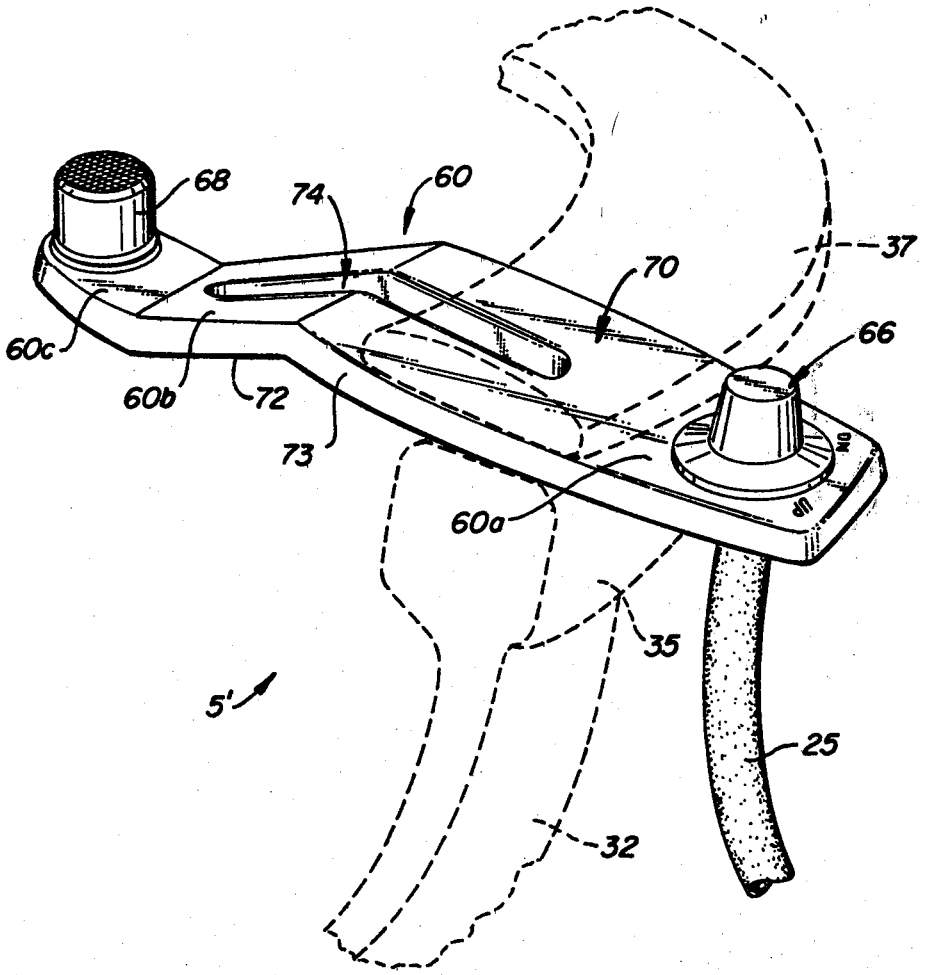
FIGS. 2 and 3 are respective top and bottom perspective views of a second embodiment of the present invention.
Figure 3:
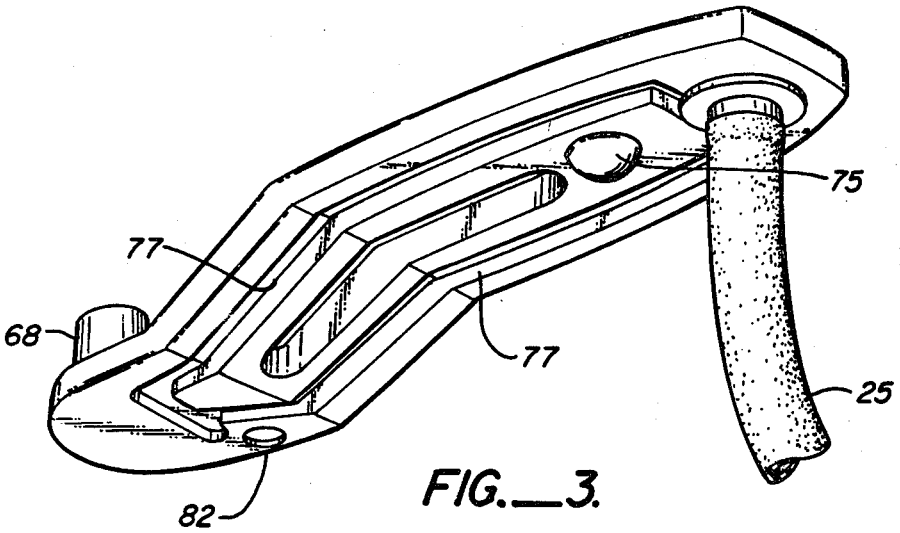
Figure 4:
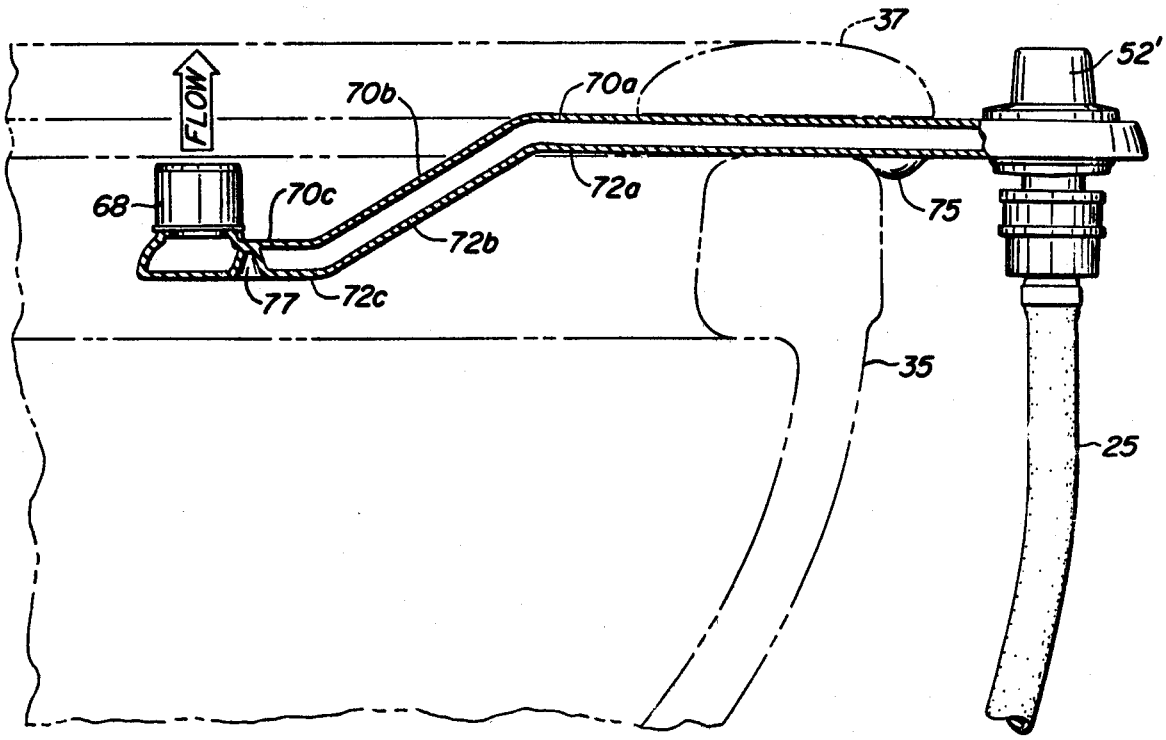
FIG. 4 is a partially sectioned side view of the second embodiment.

FIGS. 2 and 3 are respective top and bottom perspective views of a second embodiment of the present invention, designated as adaptor 5', wherein the conduits corresponding to conduits 10 and 17 of the first embodiment are defined by hollow passageways within a plastic body member 60. Body 60 is an elongate, generally plate-like element having a stepped configuration defined by a first horizontal body portion **60*a* sized to fit in the gap between toilet seat 37 and rim 35, a downwardly inclined body portion 60*b*, and a second horizontal body portion 60*c* at an elevation below that of portion 60*a*. First horizontal body portion 60*a* carries a diverter valve 66 at its end remote from second horizontal body portion 60*c*, while portion 60*c* carries an upwardly facing aerator nozzle 68. Body 60 has upper and lower walls 70 and 72, respectively, and a peripheral wall 73. Upper and lower walls 70 and 72 are defined by upper wall segments 70*a*, 70*b*, 70*c*, and 72*a*, 72*b*, 72*c* corresponding to body portions 60*a*, 60*b*, 60*c*. This is shown most clearly in the side sectional view of FIG. 4. Body 60 is formed with a medial longitudinally extending slot 74 that allows water splashing on the upper surface of upper wall 70 to run down into toilet bowl 32 rather than onto the bathroom floor. Lower wall segment 72*a* has a downward protrusion 75 proximate valve 66 to limit the movement of adaptor 5'**.

Figure 5:
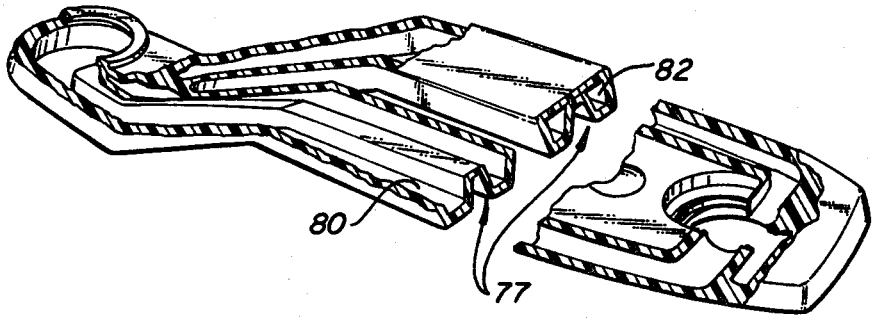
FIG. 5 is a cutaway perspective view of the body of the second embodiment.
Figure 6:
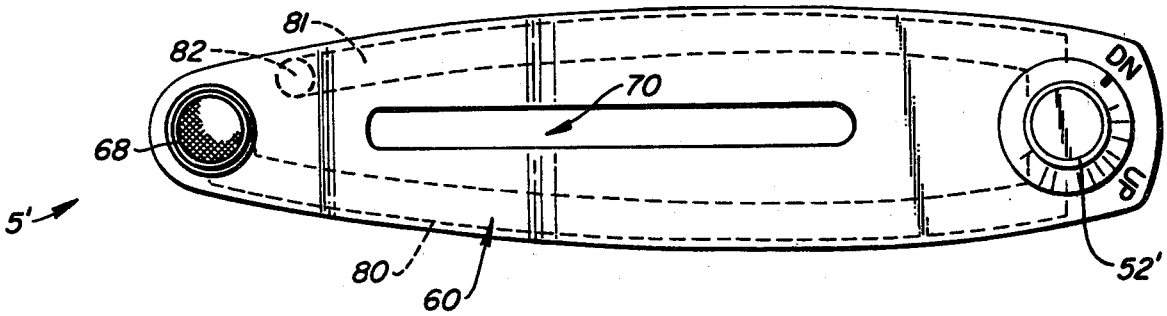
FIG. 6 is a top plan view of the second embodiment.

The internal conduits are best seen with reference to FIGS. 3, 5, and 6. FIG. 5 is a cutaway perspective view of body 60; FIG. 6 is a top plan view of adaptor 5'. Body 60 is preferably blow molded from a plastic material such as medium impact polypropylene. Lower wall 72 is formed with a downwardly opening channel 77 of sufficient depth to bring the lower and upper walls together along a contour spaced inwardly from the peripheral wall 73. This defines internal passageways bounded by outer peripheral wall 73, channel 77, and walls 70 and 72. The internal passageways define first and second conduits 80 and 81 extending along opposite longitudinally extending portions of outer peripheral surface 73. Lower wall segment **72*c* has an aperture 82 that permits liquid flowing through conduit 81 to issue downwardly into the toilet bowl, while upper wall segment 70*c* is apertured to receive nozzle 68 and communicate with conduit 80. With reference to the top plan view of FIG. 6, it can be seen that the horizontal portions of conduits 80 and 81 within body portion 60***a* are not straight, but are slightly bowed out with respect to one another. Body portion 60*a* is apertured clear through to receive diverter valve 66 which provides selective fluid flow into either of conduits 80 and 81. It is noted that portions of passageway 80 within body portions 60*b* and 60*c*, together with nozzle 68 define a U-shaped conduit portion corresponding to U-shaped conduit portion 15 of the first embodiment.

Figure 7A:
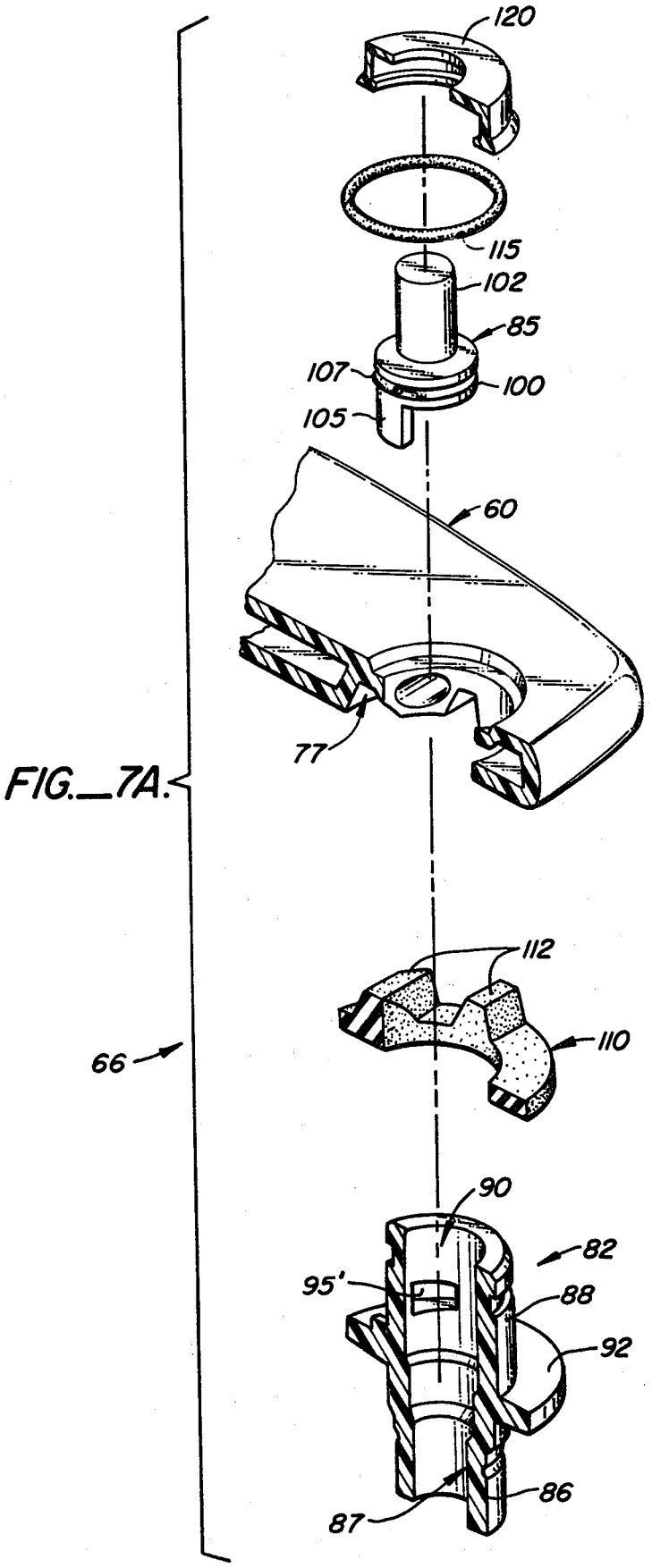
FIG. 7A is an exploded sectional isometric showing the diverter valve construction for the second embodiment.
Figure 7B:
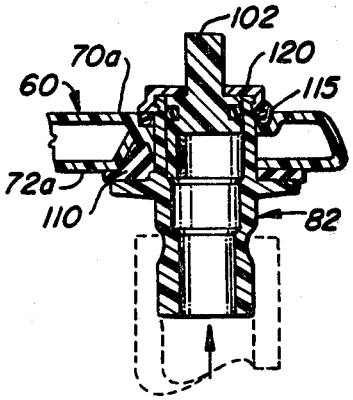
FIG. 7B is a sectional view of the diverter valve mounted to the body.

The preferred construction of diverter valve 66 may be seen with reference to the exploded sectional and side sectional views of FIGS. 7A and 7B. Broadly, valve 66 comprises a valve housing 82 and a rotor 85 rotatable within housing 82. Valve housing 82 is generally tubular having a lower portion 86 defining a fluid inlet 87 and an upper portion 88 defining a rotor chamber 90, and carries a central annular flange 92. Rotor chamber 90 is provided with paired openings, one opening 95 of which is shown. These openings communicate to respective inlet portions of conduits 80 and 81.

Rotor 85 comprises a cylindrical body portion 100, an upwardly extending valve handle 102, and a downwardly extending curved flange 105 of an angular extent to block either of the two openings in rotor chamber 90 (but not both simultaneously). Cylindrical body portion 100 is grooved to accommodate an O-ring 107 that provides a rotating seal between rotor 85 and rotor chamber 90.

Valve 66 mounted to body portion 60*a* with annular flange 92 below lower wall segment 72*a*. An annular gasket 110 fits between flange 92 and wall 72*a* of body portion 60*a*, and carries upwardly protruding ridges 112 corresponding configured with respect to channel 77. Upper valve housing portion 88 is grooved to accommodate an O-ring 115. A retainer 120 engages upper valve housing portion 88 to keep valve housing 82 firmly engaged with body 60 and to keep rotor 85 within rotor chamber 90. O-ring 115 then seals upper valve housing portion 88 to upper wall segment 70*a*.

Figure 8:
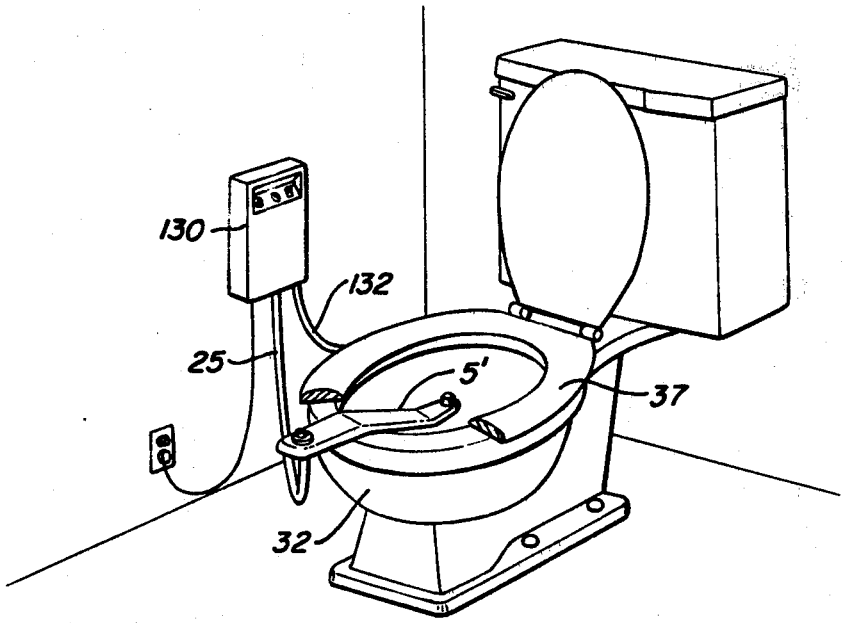
FIG. 8 is an isometric view illustrating an alternate water supply system.

The discussion above assumed that a faucet capable of supplying warm water was conveniently located within a short distance of the toilet. However, it is not uncommon practice to have the toilet located in a separate room from the sink and faucet to permit simultaneous use of the toilet and sink by two different people. FIG. 8 is an isometric view illustrating a system for supplying warm water to bidet adapter 5' where a faucet is not available to supply the warm water for operation. The system uses a thermostatically controlled water heater 103, typically wall mounted. Water heater 130 has an inlet conduit 132 which is connected to the toilet fill valve (not shown) according to well known plumbing practices. Water heater 130 has a warm water outlet to which flexible hose 25 is connected in any convenient manner. Thus, water heater 130 and its connections to the cold water supply at the toilet fill valve take the place of faucet 27 of FIG. 1.

It can thus be seen that the present invention provides a portable bidet adaptor that is inexpensively fabricated and simple to use. The bidet adaptor is versatile in that it its position over the toilet bowl is easily varied. With the valve handle set at a position intermediate the extremes, water is directed into both conduits simultaneously, thus allowing the user to regulate the flow intensity of the upwardly discharging stream of water.

While the above provides a full and complete disclosure of the preferred embodiments of the invention, various modifications, alternate constructions, and equivalents may be employed without departing from the true spirit and scope of the invention. For example, while a blow molded construction is disclosed as the preferred embodiment, rotational molding, injection molding, or vacuum forming could be used. Also, it would be possible to fabricate body portion 60 by laminating a cover plate to a channelled plate to define the conduits. Moreover, while polypropylene is disclosed, other thermoplastic materials such as ABS, high impact polystyrene, or polycarbonate could be used. Therefore, the above description and illustration should not be construed as limiting the scope of the invention which is defined by the appended claims.

I claim:

1. A portable bidet adaptor for use with a toilet having a bowl, a peripheral rim of predetermined thickness along an upper region of the bowl, and a seat, with the seat overlying the rim of the bowl and spaced apart therefrom by a predetermined gap spacing, comprising:

a generally horizontal rigid conduit having first and second ends and being sized to fit between the seat and the rim;

upwardly opening means in fluid communication with the second end of the generally horizontal conduit for discharging in an upward column liquid that is introduced into the first end of the generally horizontal conduit and flowed through the generally horizontal conduits;

the generally horizontal conduit being sufficiently long in relation to the predetermined thickness of the rim and substantially free of vertical projections beyond the predetermined gap spacing over a sufficient distance to freely slide to provide movement of the upward column toward and away from the rim;

diversion means for downwardly directing the liquid into the bowl while maintaining the column discharging means in an upwardly open position; and stabilization means associated with the diversion means for preventing rotation of the bidet adaptor about a horizontal axis.

2. The invention of claim 1, and further comprising:

in addition to the first-mentioned generally horizontal conduit, a second conduit having a normally downwardly open end disposed over the bowl; and a diverter valve having inlet means for receiving liquid and means for selectively directing the liquid into one of the first-mentioned and second conduits;

the diversion means being defined by the second conduit and the diverter valve.

3. The invention of claim 2 wherein the diverter valve is also operable to direct respective portions of the liquid into the first-mentioned and second conduits at the same time.

4. The invention of claim 1 or 2 wherein the generally horizontal conduit is straight.

5. The invention of claim 1 or 2 wherein the generally horizontal conduit is curved about a vertical axis.

6. The invention of claim 2 wherein the first-mentioned and second conduits are at least in part defined by hollow passageways within an integrally formed plastic body member.

7. A portable bidet adaptor for use with a toilet having a bowl, a peripheral rim along the upper region of the bowl and a seat adapted to overlie the rim in spaced relationship therefrom by a predetermined gap, comprising:

a first rigid conduit having a generally horizontal portion, a generally U-shaped portion at an end thereof, the U-shaped portion having an upwardly opening end segment for discharging liquid in an upward column of water when pressurized liquid is introduced into the horizontal portion, the horizontal portion being sized to fit within the predetermined gap spacing;

a second rigid conduit having a horizontal portion and a downwardly opening portion contiguous therewith, the horizontal portion of the second conduit being sized to fit within the predetermined gap spacing; and a diverter valve having an inlet for receiving liquid and means for selectively directing the liquid into one of the first and second conduits;

the horizontal portions of the first and second conduits being spaced apart to vertically stabilize the upwardly opening end segment and the downwardly opening portion while allowing motion of the upwardly opening end segment toward and away from the rim to permit adjustment of the location of the upwardly discharging column of liquid.

8. The invention of claim 7 wherein the generally U-shaped portion includes a downwardly extending vertical segment contiguous with the generally horizontal portion.

9. The invention of claim 7 wherein the generally U-shaped portion includes a downwardly sloping segment contiguous with the generally horizontal portion.

10. The invention of claim 8 or 9 wherein the end segment is at least in part defined by a vertical nozzle.

11. A portable bidet adaptor for use with a toilet having a bowl, a peripheral rim along the upper region of the bowl and a seat adapted to overlie the rim in spaced relationship therefrom by a predetermined gap, comprising:

a first rigid conduit having a generally horizontal protion being sized to fit within the predetermined gap spacing, a downwardly inclined segment contiguous therewith, and an upwardly opening end segment terminating at its upper end below the top surface of the toilet seat for discharging liquid in an upward column when pressurized liquid is introduced into the horizontal portion;

a second rigid conduit having a horizontal portion and a downwardly opening portion contiguous therewith, the horizontal portion of the second conduit being sized to fit within the predetermined gap spacing; and a diverter valve having an inlet for receiving liquid, and manually actuable means for selectively directing the liquid into a desired one of the first and second conduits;

the horizontal portions of the first and second conduits being spaced apart horizontally to vertically stabilize the upwardly opening end segment and the downwardly opening portion while allowing motion of the upwardly opening segment toward and away from the rim to permit adjustment of the location of the upwardly discharging column of liquid.

12. The invention of claim 11 wherein the first and second rigid conduits are defined by hollow passageways within an integrally formed plastic body member.

* * * * *